US006419218B1

(12) United States Patent
Hartsoe et al.

(10) Patent No.: US 6,419,218 B1
(45) Date of Patent: Jul. 16, 2002

(54) STREAMFEEDER SIGNATURE LONG TAIL TRIMMER

(75) Inventors: Allen D. Hartsoe, Boiling Springs, SC (US); Robert E. Davis, Salem, VA (US)

(73) Assignee: R. R. Donnelly & Sons Company, Chicago, IL (US)

( * ) Notice: Subject to any disclaimer, the term of this patent is extended or adjusted under 35 U.S.C. 154(b) by 0 days.

(21) Appl. No.: 09/504,263

(22) Filed: Feb. 15, 2000

Related U.S. Application Data

(60) Provisional application No. 60/120,719, filed on Feb. 16, 1999.

(51) Int. Cl.[7] ..... B65H 39/04

(52) U.S. Cl. ..... 270/52.17; 270/52.16; 270/58.02; 83/934; 271/250

(58) Field of Search ..... 83/934; 270/52.14, 270/52.16, 52.17, 52.18, 52.26, 52.29, 58.02; 271/220, 221, 222, 250, 248, 238

(56) References Cited

U.S. PATENT DOCUMENTS

| | | | | |
|---|---|---|---|---|
| 2,490,085 A | * | 12/1949 | Nordquist et al. | 271/233 |
| 3,884,102 A | | 5/1975 | Faltin | |
| 4,076,231 A | * | 2/1978 | Kutzner et al. | 270/52.17 X |
| 4,381,108 A | * | 4/1983 | Newsome | 271/198 |
| 4,507,037 A | | 3/1985 | Fenimore | |
| 4,511,131 A | * | 4/1985 | Raybuck | 270/52.17 |
| 4,522,384 A | * | 6/1985 | Beckley | 270/52.29 |
| 4,607,831 A | * | 8/1986 | Raybuck | 271/221 X |
| 4,667,809 A | * | 5/1987 | Raybuck | 271/221 |
| 5,100,116 A | * | 3/1992 | Graushar | 270/52.26 X |
| 5,377,965 A | | 1/1995 | Mandel et al. | |
| 5,660,515 A | | 8/1997 | Hartsoe | |
| 5,678,813 A | | 10/1997 | Osako et al. | |

* cited by examiner

*Primary Examiner*—Christopher P. Ellis
*Assistant Examiner*—Patrick Mackey
(74) *Attorney, Agent, or Firm*—Fitch, Even, Tabin & Flannery

(57) ABSTRACT

A streamfeeder for the untrimmed, folded cover signatures includes an uphill streamfeeder with the cover signatures disposed between a pair of conveyor belts with a jogger being on the side of the folded signatures opposite the long tail. The preferred cutter for the long tail, cover signatures comprises a rotating, slitting wheel and an opposing, rotating anvil. The slitting wheel is preferably a rotating disc with a beveled, cutting edge that cooperates with a resilient insert on the anvil. Herein, the cutting wheel is mounted on a rotary shaft and rotated by a variable speed drive.

25 Claims, 9 Drawing Sheets

STREAMFEEDER SIGNATURE LONG TAIL TRIMMER

This application claims the benefit of U.S. provisional application No. 60/120,719, filed Feb. 16, 1999.

BACKGROUND OF THE INVENTION

This invention relates to a method and apparatus for removing long tails from folded signatures and collating the trimmed signatures with the other folded signatures in a bindery line.

The so-called "long tail" folded signatures have a longer length than the other folded signatures being collated on the bindery line. Usually, the longer length is due to printing of the signatures on an offset printing press, where the length is limited to defined increments which do not exactly match the length of the other signatures being printed on a Gravure printing press, where the length of the signature can be set to the desired length. Often, the long tail, folded signatures are cover signatures which are the outer cover pages for the book of folded signatures after they are stitched or otherwise bound to one another. In some instances, the long tall, folded signatures are inserts that are dropped onto the saddle upstream of other signature feeding stations which thereafter drop the remaining signatures over the now-trimmed, former long tail signatures. Heretofore, the long tail, folded signatures were cut in an off-line process manually using a bracket trimmer or a flat bed cutter. An operator would take 50 or 100 long tail signatures and manually operate the bracket trimmer or flat bed cutter to cut these signatures to size. Typically, a cut of about 1 to 1⅛ inches was trimmed and was waste.

In U.S. Pat. No. 4,507,037, a cover signature is transferred and collated with the other signatures; and at a next station, the signatures are jogged and registered and then center stitched with the head and tail being trimmed at the next station prior to folding the signatures. This United States Patent is directed to a web conveyor line where the signatures are flat and unfolded when the cover signature is added, rather than being folded signatures being carried on a saddle.

SUMMARY OF THE INVENTION

In accordance with the present invention, long tails of folded cover signatures are trimmed while being fed to a pocket feeder from which the trimmed, folded signatures are dropped onto collated, folded signatures being carried along by a bindery line conveyor. In the preferred embodiment of the invention, the already-folded, long tailed signatures are fed in an overlapped or shingled condition by a jogger type of stream feeder through an on-line trimming station where a jogger/pusher pushes against the long signatures to force them laterally against a stationary, registering surface such as a side guide. The registered, untrimmed cover signatures then travel into the trimming station where the edge opposite the long tail is trimmed. The trimmed waste goes into a collecting chute or box, and a vacuum hose conveys the trimmed waste to a main recovery system. The trimmed, folded, cover signatures are fed into a pocket feeder board that jogs and places the trimmed cover signatures for automatic griping, rotating and dropping in timed sequence onto a collated stack of signatures on the saddle.

In accordance with the preferred embodiment of the invention, the preferred stream feeder for the untrimmed, folded cover signatures includes an uphill streamfeeder with the cover signatures disposed between a pair of conveyor belts with the jogging means being on the side of the folded signatures opposite the long tail. The preferred cutting means for the long tail, cover signatures comprises a rotating, slitting wheel and an opposing, rotating anvil. The slitting wheel is preferably a rotating disc with a beveled, cutting edge that cooperates with a resilient insert on the anvil. Herein, the cutting wheel is mounted on a rotary shaft and rotated by a variable speed drive.

After being dropped into the signature feed boxes, the trimmed cover signatures are then fed by a rotary gripper mechanism to drop onto a stack of collated signatures to complete the covered book. After stitching, the final book including the previously-trimmed cover is trimmed to the final book size.

DETAILED DESCRIPTION OF THE PREFERRED EMBODIMENT

Figure 3:
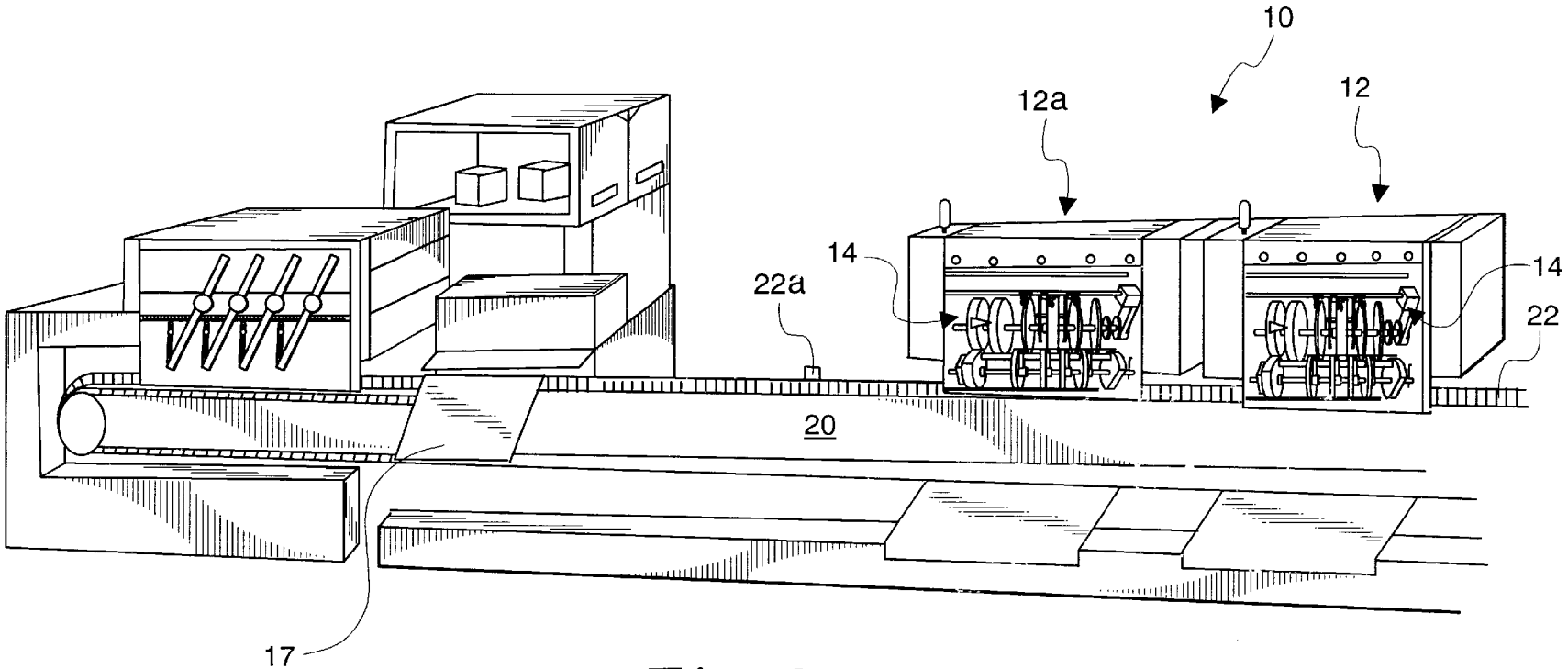
FIG. 3 is a view of a bindery line apparatus and pocket feeders.

As shown in the drawings, for purposes of illustration, the invention is embodied in a bindery apparatus 10, which comprises a plurality of pocket feeders or pocket machines 12, 12*a*, 12*b* . . . 12*x*, each of which has a rotating gripping mechanism 14 (FIG. 3) which removes a folded signature 16 from a pocket hopper 12 and opens and drops the opened V-shaped signature onto the V-shaped saddle 20. Typically, each of the pocket feeders feeds and drops a signature in timed relationship onto a gathering conveyor 22 having lugs 22*a* to abut the trailing edges of the signatures being collated to make a book form 17. Often the book forms have included therein a long tail signature 16*x* which is usually an outer or cover signature, which may have one or more sheets; and it is dropped over the interior signatures to cover them. When the cover sheet signature 16*x* is printed on an offset press, it typically has a long tail 25 that must be trimmed, heretofore this has been done manually, as explained above. The cover signatures are provided in a large log or cylindrical reel 33A, and a person would remove 50 or 100 signatures from the log and trim off the long tail along a trim line 28 to make the long tail signatures 16*x* to the same length or size as the remaining signatures of the booklet form. A log usually has 250–350 signatures therein. The now-trimmed, formerly long-tailed signatures 16*x* are then assembled into a log by the person doing the trimming. This log would then be transported on a pallet from the remote off-line, trimming location to the bindery apparatus 10 and placed into a signature feed hopper 12 of a signature feeder. Usually, the trimmed signature 16*x* is a cover signature, and hence, will be termed a "cover" signature herein; but the trimmed signature 16*x* may be an insert covered by other signatures such as a gravure printing signature disposed in the middle of offset printed newspaper signatures.

Figure 1:
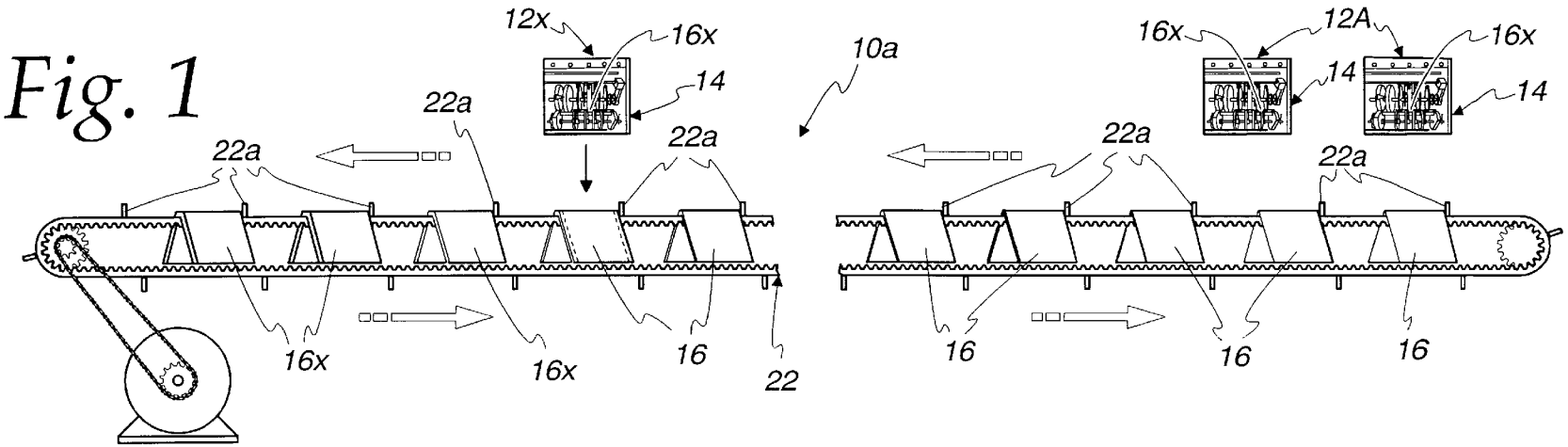
FIG. 1 is a diagrammatic view of a bindery line apparatus having an in-line slitter for removing long tails from signatures and feeding them from a pocket feeder to a saddle.
Figure 2:
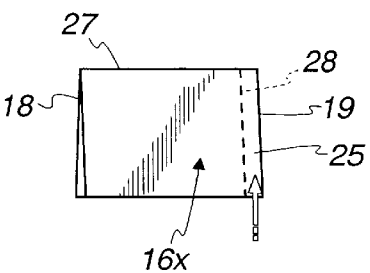
FIG. 2 is a view of a long tail signature.
Figure 1B:
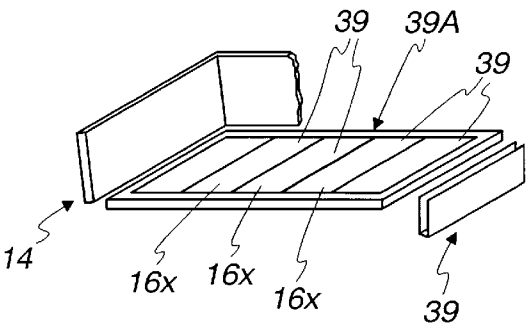
FIG. 1B illustrates diagrammatically a switch control mechanism to match the feed rate of the streamfeeder to that of the pocket feeder.

In accordance with the present invention, there is provided a new and improved bindery apparatus having a cover signature trimming device 30 for cutting the cover signatures 16*x* to the correct length "in-line" instead of "off-line". This is achieved by use of a streamfeeder 32 for feeding cover signatures 16*x* in shingled form to and through a trimming station 34, at which a trimming knife or cutter 36 cuts the long tail 25 from the cover signatures as the signatures are conveyed by a conveyor 38 through the trimming station. The streamfeeder 32 is connected to the drive for the bindery apparatus and is under a switch control mechanism (FIG. 1B) to keep the desired amount of cover signatures in the hopper. The preferred streamfeeder feeds the cover signatures in shingled form with their folded edges 27 leading in the direction of travel. A jogger or alignment device pushes on one edge 18 of the shingled signatures to register their opposite edge 19 against a side guide 72. Thus, it will be seen that considerable economies are achieved by dropping a log of cover signatures 16*x* into a streamfeeder hopper 33 (FIG. 1A) which strips the bottom signatures 16*x* from the log one at a time and shingles them onto the streamfeeder conveyor 38. The conveyor 38 conveys and jogs into side registry the shingled cover signatures before they pass through the trimming station 30 and conveys the trimmed cover signatures into the signature feeder 12*x* at a feed rate determined by the feed rate of the bindery line conveyor. For purposes of illustration only and, as shown diagrammatically in FIG. 1B, a limit switch 39*a* is shown in FIG. 1B to detect a length or pile of signatures 39 in the signature feeder hopper 14 of the signature feeder machine 12*x*. When the number of signatures in the hopper is reduced, the limit switch senses this and operates a circuit to cause the streamfeeder to jog more signatures 16*x* into the hopper 14. When the hopper has a predetermined number of signatures 16*x*, the limit switch opens the drive circuit for the streamfeeder motor to stop further feeding of signatures 16*x* into the hopper 14. Thus, the streamfeeder is operated intermittently in this instance to time the feed rates of signatures into and from the pocket feeder 12*x*.

In accordance with the present invention, the cutter 36 is driven in timed relationship to the conveyor 38 of the streamfeeder 32, and the latter is driven in timed relationship to the rate at which the pocket feeder 12*x* is feeding the cover signatures 16*x* onto the gathering conveyor 22. Preferably, the jogger is also driven in timed relationship to the conveyor 38 of the streamfeeder. Herein, the preferred driving of the cutter 36 is achieved by directly connecting a cutter drive socket 126 to the main drive shaft 102 of the streamfeeder.

Figure 4:
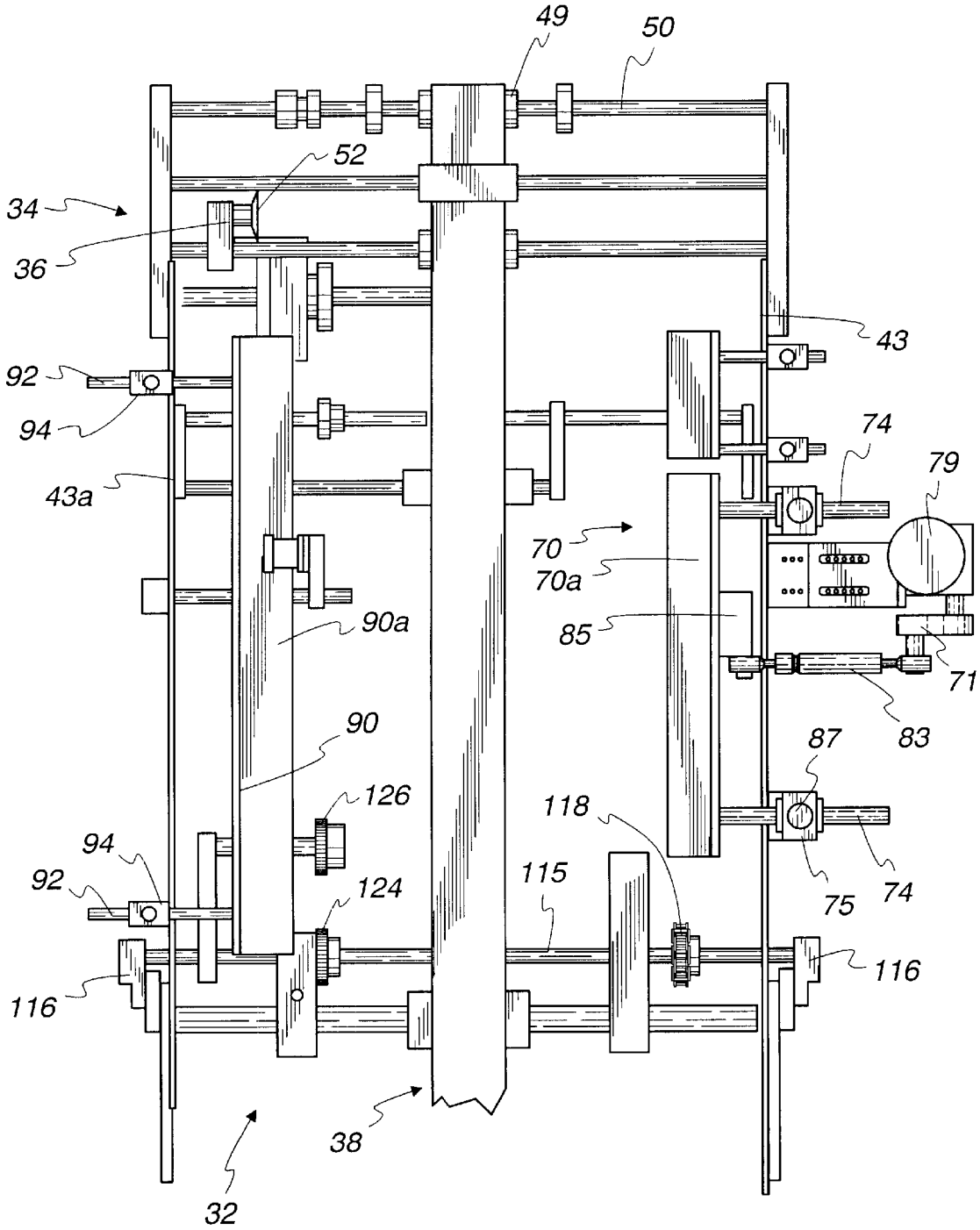
FIG. 4 is a plan view of a streamfeeder with a long tail slitter mounted thereon.
Figure 5:
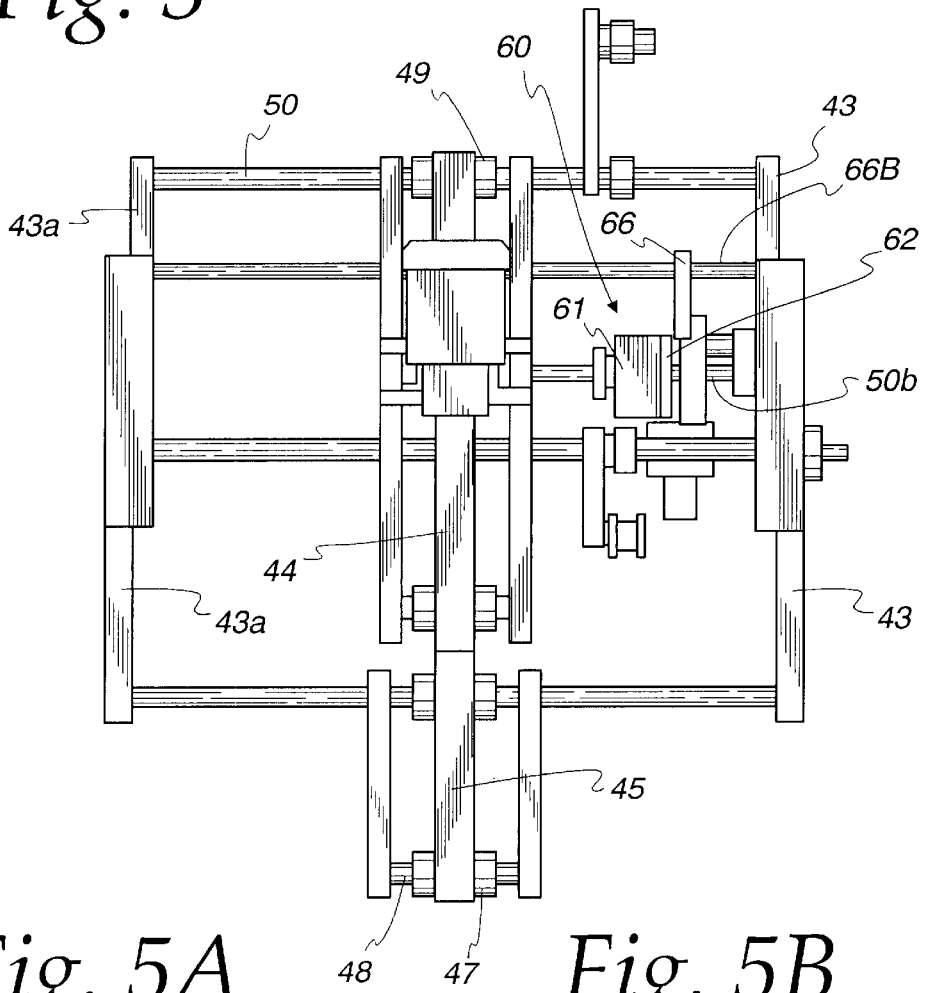
FIG. 5 is a front elevational view of a streamfeeder with the long tail slitter mounted thereon.

Referring now in greater detail to the illustrated embodiment of the invention (FIG. 4), the streamfeeder illustrated herein is a McCain streamfeeder 32 having side plates 43 and 43a that extend at an upwardly incline to raise the shingled signatures 16*x* as they are carried forwardly between an upper conveyor belt 44 and a lower conveyor belt 45 (FIG. 5) from the log 33A of signatures in the streamfeeder hopper 33. A vacuum device, which is standard on the streamfeeder, removes the lowest folded cover signature 16*x* from the log and inserts it between the upper and lower conveyor belts, which convey it upwardly over the top of the McCain streamfeeder and then deposit it in the pocket machine hopper 14. As illustrated in FIGS. 4 and 5, the belts extend upwardly from a lower, rotatable roller 47 mounted on a shaft 48 between a pair of lower frame side frame plates 43 and 43*a* (FIG. 5). At the top of the streamfeeder 32 is a belt mounting roller 49 on a shaft 50 extending horizontally and spanning the side plates 43 and 43*a*.

Figure 6:
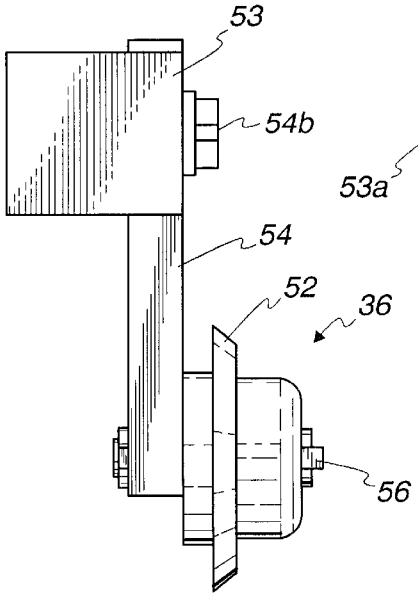
FIG. 6 is a side elevational view of a slitter assembly.
Figure 7:
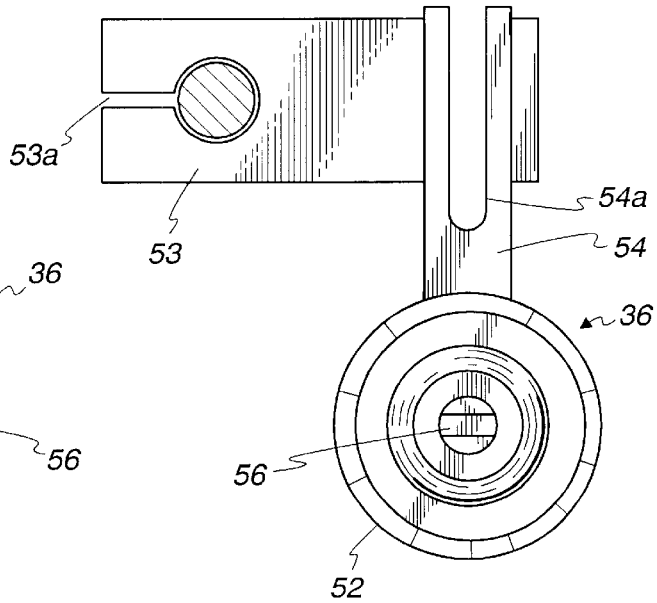
FIG. 7 is a front elevational view of the slitter assembly of FIG. 6.
Figure 8:
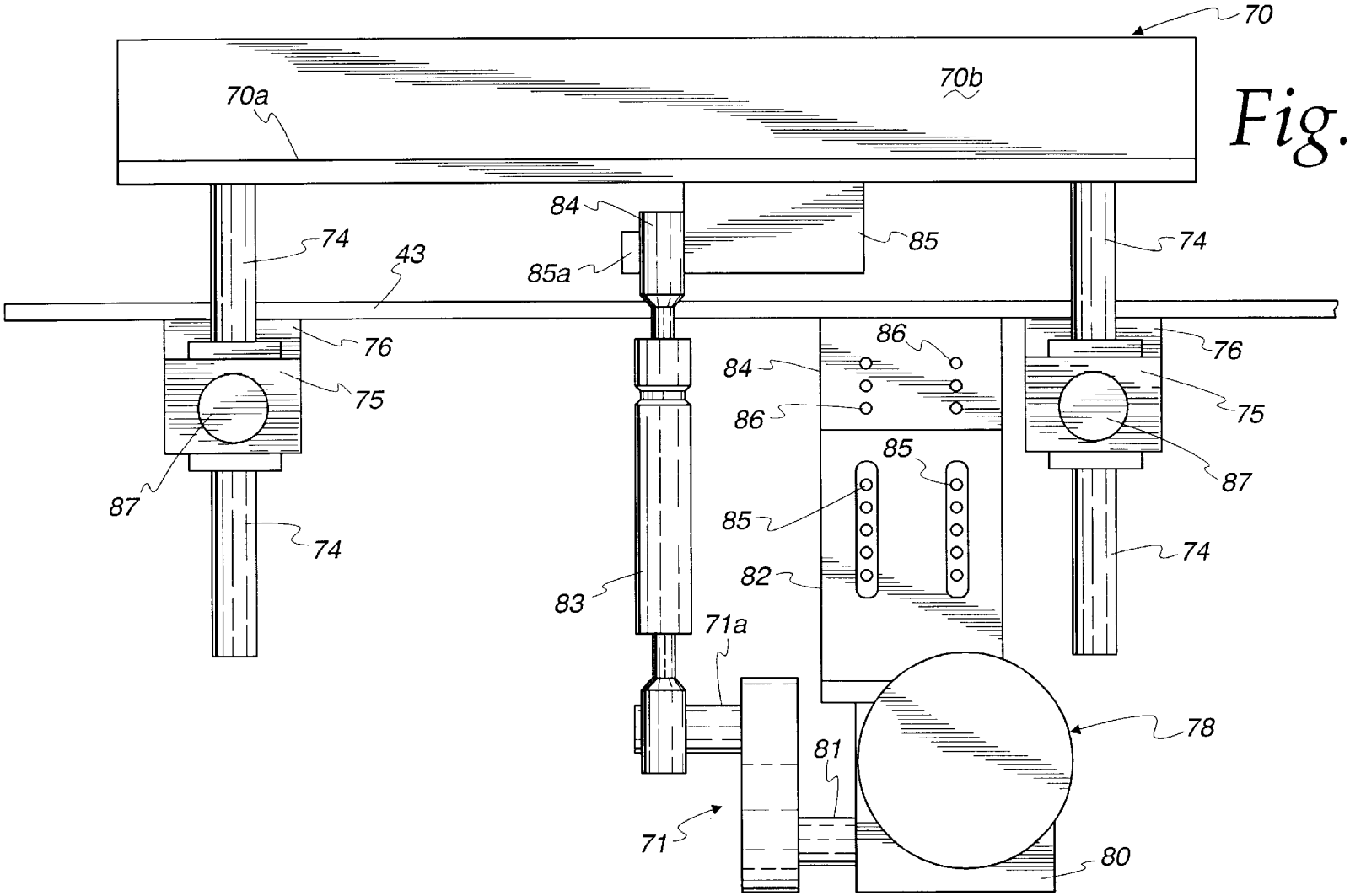
FIG. 8 is a plan view of the jogger assembly.

For the purpose of cutting the long tails 25 from the long tail signatures 16*x* while in-line with the pocket machine 12*x*, the streamfeeder has been provided with the slitter 36 at the trimming station 30 adjacent the top the streamfeeder, as best seen in FIG. 4. The preferred slitter 36 is best seen in FIGS. 6, 7 and 8 and comprises a slitter assembly having a beveled, circular slitting blade 52 carried by a pair of bracket plates 53 and 54 to turn about a central axle and axis 56 mounted on the lower end of the vertically-extending bracket plate 54. The illustrated slitter assembly is commercially available from Charles Koegel and Son's and comprises a 4.5 inch slitter blade. The elongated, vertical bracket 54 supporting the slitter has an elongated vertical slot 54*a* therein to receive the fastener 54*b* (FIG. 6) to secure the slitter blade at an adjusted depth of cut for the particular thickness of the folded, signature 16*x*. The bracket 53 has a slotted end 53*a* (FIG. 7) to receive a bolt (not shown) to clamp the bracket on the horizontal support shaft 54*b* to adjust the size of the trimmed tail—e.g., about 1⅛ inches in this instance. Manifestly, other slitter assemblies could be used other than that described above.

Disposed beneath the slitter blade and aligned therewith is a rotatable anvil 60 (FIG. 5) which is mounted on a horizontal shaft 50*b* parallel to and below the slitter shaft 50*a*. The illustrated anvil 60 comprises a pair of rotatable discs 61 and 62 (See FIG. 5) with a resilient insert therebetween to hold the lower side of the signature as it is being slit by the upper, rotating slitter blade 52.

Figure 5A:
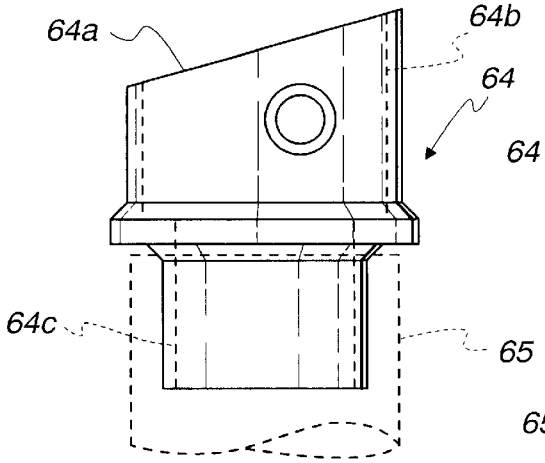
FIGS. 5A and 5B are elevational views of a scrap collector and attached hose.
Figure 5B:
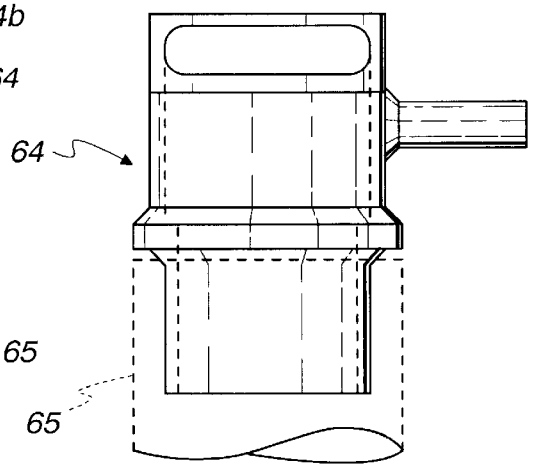
Figure 5C:
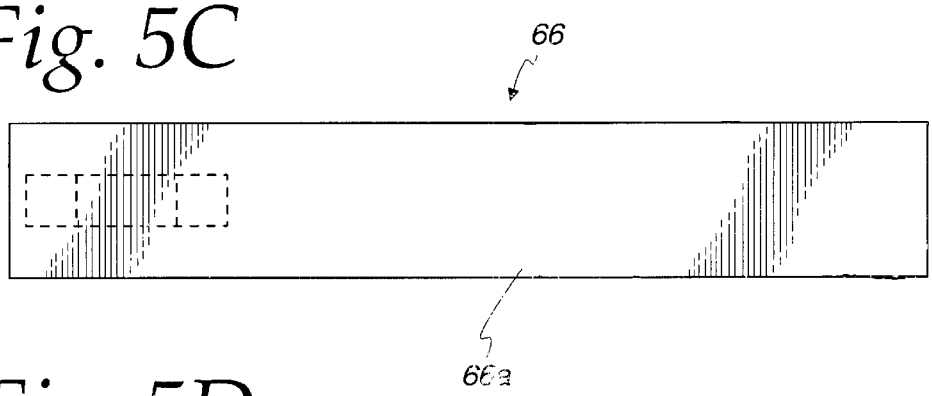
FIGS. 5C and 5D are plan and elevational views of a scrap deflector.
Figure 5D:
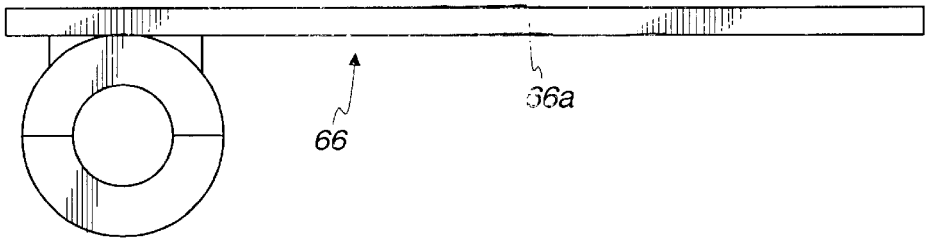

As best seen in FIG. 5, the waste trimmed from the long tail signature 16*x* drops from the anvil into a slitter waste collector 64, which is connected to a vacuum hose 65 which conveys the waste away. As best seen in FIG. 5, a slitter waste deflector 66 is mounted on a shaft 66*b* to deflect the waste as it curls after being cut into the waste collector 64. Thus, the waste is removed while the slitting is taking place in an automatic manner. The waste collector 64 has an open mouth 64*a* (FIG. 5A) with a hollow interior 64*b* through which the waste drops into a smaller hollow portion 64*c* to which is secured the upper end of the vacuum hose 65. The deflector 66 has a flat strip 66*a* (FIGS. 5C and 5D) to deflect a ribbon-like waste of the tails into the opening 64*a* of the waste collector 64.

Figure 9:
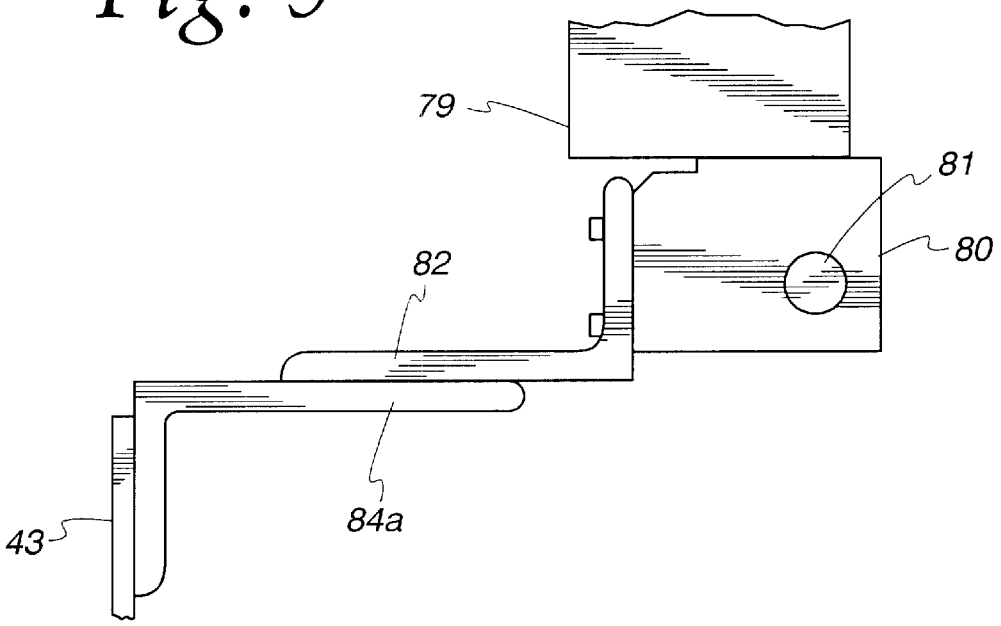
FIG. 9 is an enlarged, side view of the jogger motor and its adjustable mounting bracket.

For the purpose of aligning the edges 18 and 19 of the long tail signatures 16*x*, as they are conveyed toward the trimming station 34, the illustrated jogger (FIG. 1*a*) comprises reciprocating guide plates 70 on one side of the streamfeeder to abut the opposite edge of the signatures 16*x* against a stationary guide assembly 72. The guide assembly 72 could also be driven to reciprocate if so desired. The reciprocating guide plate is slidably mounted and guided by a pair of parallel, horizontal slide shafts 74 (FIG. 8) mounted in slide bushings 75 carried by stationary brackets 76 and fixed to the side frame plates 43 of the streamfeeder 32. The reciprocating of the guide plate is accomplished by a motor drive 78 (FIGS. 8 and 9) including an electric motor 79 having a gear drive 80 having an output shaft 81 for turning an eccentric crank 71, which has an output shaft 71*a* rotatably mounted in a bushing in an end of a push/pull link 83. A bushing 84 on the opposite end of the push-pull link receives a shaft 85*a* of turnbuckle block 85, which is affixed to the reciprocable guide plate 70. The preferred guide plate has an upstanding flange 70*a* to abut edges 18 of the signatures 16*x* and a horizontal flange 70*b* to support these edges resting thereon.

Figure 10:
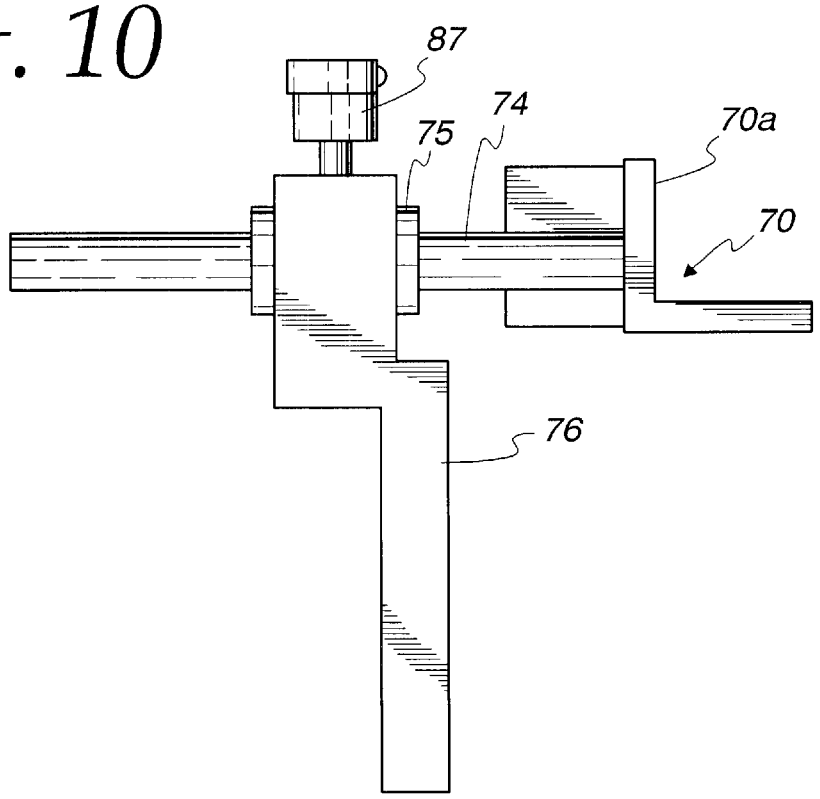
FIG. 10 is a side elevational view of the slidable guide of the jogger assembly.

For the purpose of adjusting the position of the jogger assembly for different sizes of signatures 16*x* or to reposition the jogger guide plate 70, the jogger motor is quickly shifted by sliding its upper bracket support plate 82 (FIGS. 8 and 9) along the supporting surface of underlying bracket support plate 84*a*, which is fastened to the stationary feeder side plate 43. Aligned holes 85 and 86 in the respective brackets support plates receive bolt fasteners (not shown) to secure the upper bracket support plate in its adjusted position. The link is an adjustable turnbuckle, so it also may be adjusted when desired. The slide shafts 74 merely slide in their supporting bushing 75 when the jogger motor and guide plate 70 is shifted to adjust its upstanding, jogging surface 70*a*. As best seen in FIG. 10, oilers 87 are mounted on the top of each of the bronze bushings to lubricate the sliding shafts 74 as they reciprocate in the bushings.

Figure 11:
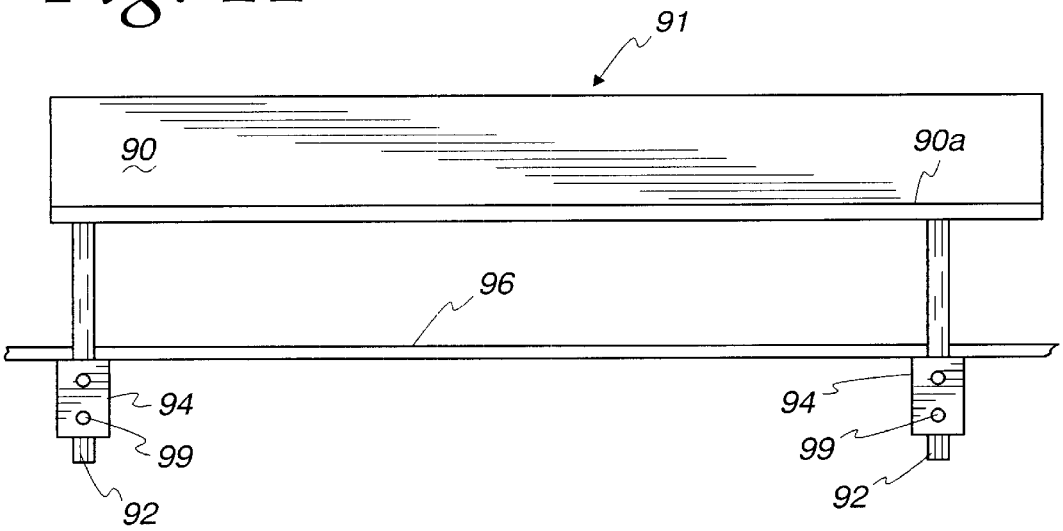
FIG. 11 is a plan view of a stationary signature guide.
Figure 12:
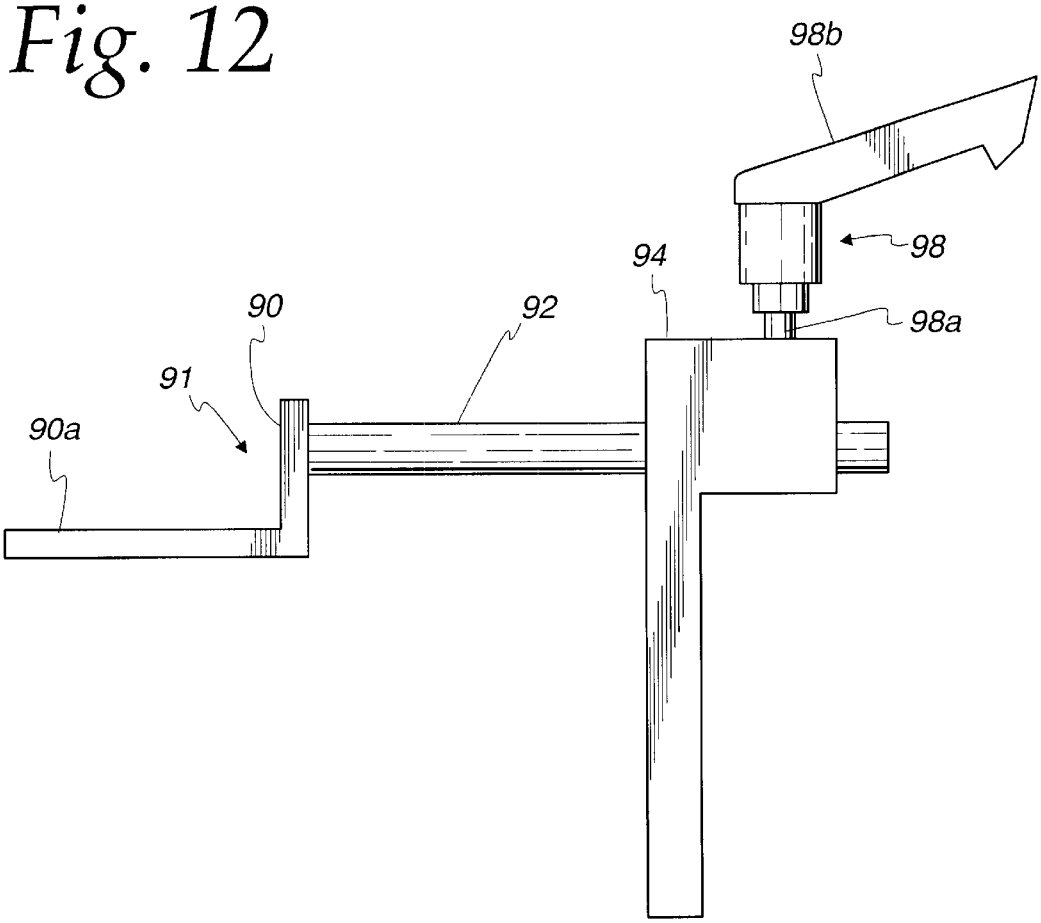
FIG. 12 is a side elevational view of a lock handle assembly for a stationary guide assembly.

As the upstanding edge abuts and delivers several strokes to the edge 18 of the signature 16*x*, it is pushed laterally to slide between the upper and lower conveyor belts 44 and 45 of the streamfeeder 32 to abut an upstanding flange 90 of a stationary guide 91 (FIGS. 11 and 12). The stationary guide 91 adjustably supported to slide laterally to position to precisely locate the edges 19 of the signatures 16*x* to position the trim line 28 of the signatures precisely for the cutter 36 by a pair of parallel, horizontal shafts 92 slidably mounted in bores of stationary guide mounting blocks 94, which are affixed to a stationary, frame side plate 96 of the streamfeeder 32. Threaded adjustment locks 98 (FIG. 12) have threaded shafts 98*a* which are threaded into a threaded bore 99 to engage the top of the shafts 92. To lock the upstanding flange 90 of the guide plate 91 at the desired position, a handle 98*b* on the lock 98 is turned to thread the shaft 98*a* deeper into the block 94. The preferred guides 91 have a horizontal leg 90*a* at right angles to the upstanding flange to receive and support the edges of the signatures 16*x* resting thereon. Also, a stationary short side guide of identical construction may be placed after the jogger 70, as shown in FIG. 4. The long stationary guide has been described in detail so the short guide need not be described in detail herein.

Figure 1A:
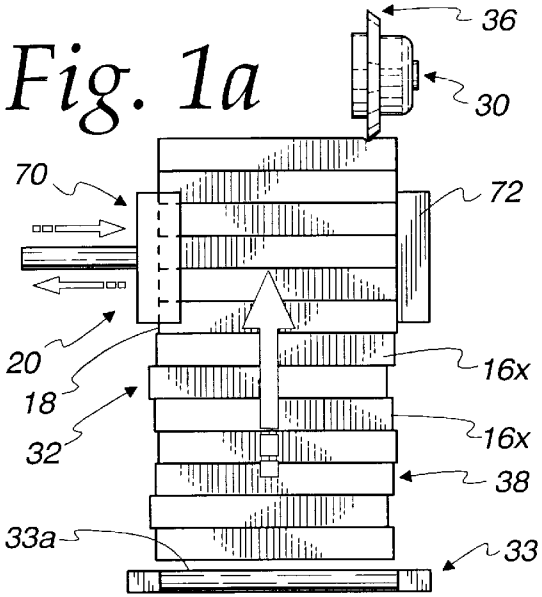
FIG. 1A is a diagrammatic view of a jogging and slitting apparatus on a streamfeeder and embodying the invention.

The timing of the jogger motor reciprocation is electrically controlled to deliver several reciprocating strokes to the shingled, long tail signatures 16*x* to abut their edges 18 and to slide them laterally through the upper and lower conveyor belts 44 and 45 to abut opposite signature edges 19 against upstanding flanges 91 of the long stationary guides 90. Thus, the jogger/pusher aligns the long tails 25 of the signatures 16*x* for slitting along the trim line 28 by the slitter 36. It is to be understood that the positions of the stationary guide 91 and the jogger/pusher guide 70 may be reversed with the movable guide 70 abutting the signature edges 18 and the stationary guide 91 aligning the signature edges 19. Likewise, the tail 25 may be on the left side of the signatures 16*x* rather than the right side of the signatures, as illustrated in FIG. 1A.

Figure 13:
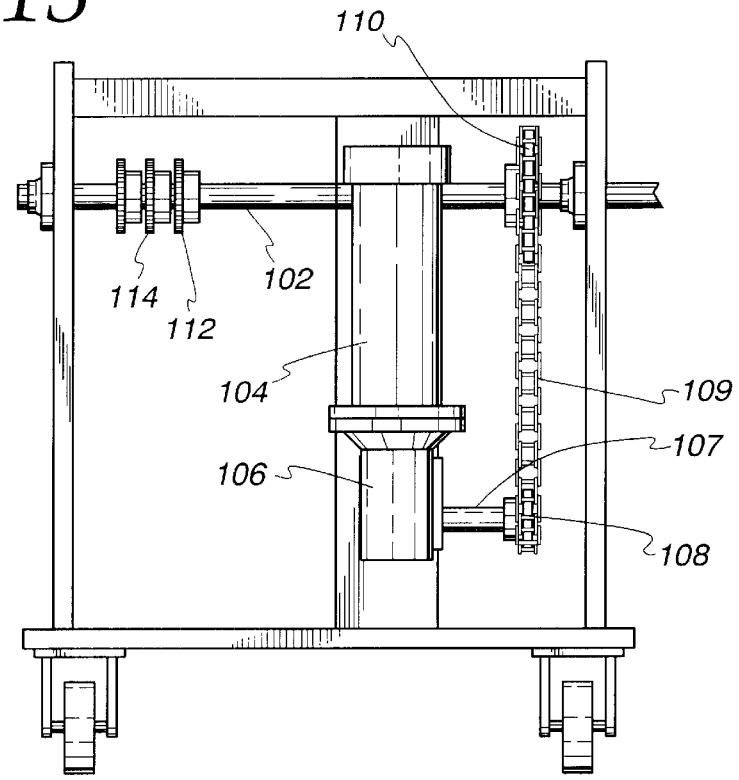
FIG. 13 is a view of the main drive of the streamfeeder with additional sprockets thereon to drive the slitter assembly.
Figure 14:
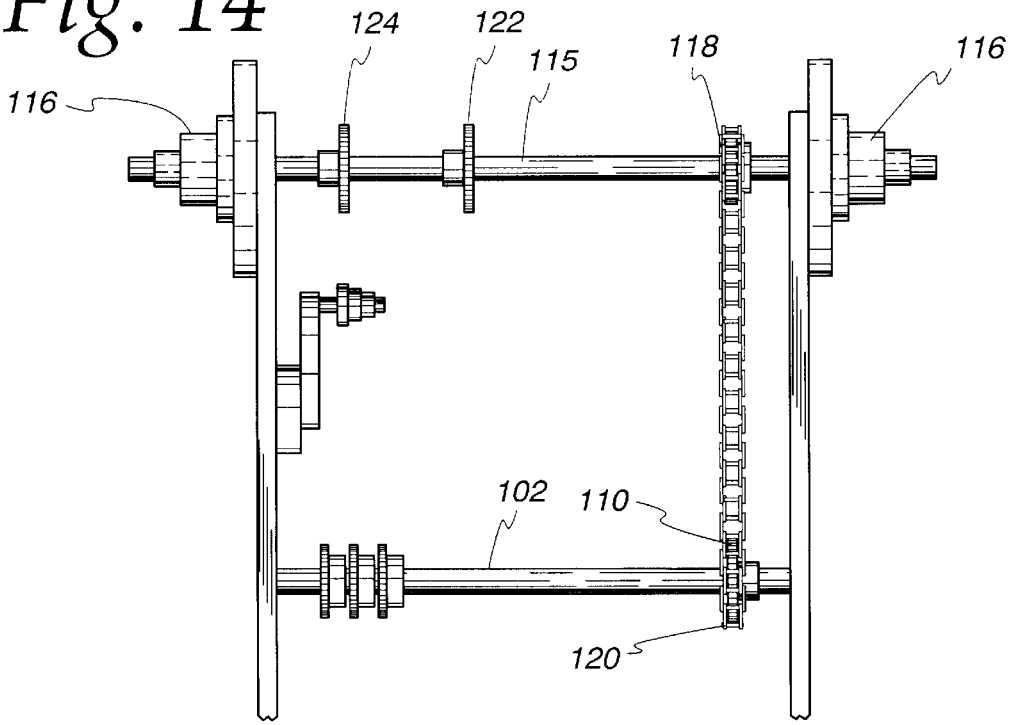
FIG. 14 is an elevational view of the main drive shaft and the added jack shaft driven by the main drive shaft.

The drive for the slitter 36 and cooperating anvil 60 is from a main drive shaft 102 driven by a main motor drive 104 (FIG. 13) driving a gear reducer 106 having an output shaft 107 and attached sprocket 108 to drive a chain 109. The chain 109 is entrained about a sprocket 110 on the main drive shaft 102 to rotate the shaft. The drive for the rotating slitter is from a sprocket 112, which is added to and attached to the main shaft and the drive for the anvil is from a sprocket 114, which is added to and attached to the main drive shaft 102. Thus, the slitter 36 operates only when the streamfeeder 36 is driven by the main streamfeeder motor 104, which also supplies the power to rotate the slitter assembly 51 and the cooperating rotating anvil 60. As best seen in FIGS. 4 and 14, a jack shaft 115 has been added to streamfeeder and spans its side plates and is journaled to rotate in bearings 116. The jack shaft 115 carries a sprocket 118 (FIG. 14) driven by a chain 120 which extends to the sprocket 110 on the main drive shaft 102 to rotate the jack shaft 115 with the main shaft 102 of the streamfeeder 32. A separate anvil drive for the rotatable anvil is from a sprocket 122 fixed to the jack shaft, an anvil drive sprocket 124 (FIG. 14) is affixed to the jacket shaft and drives a chain, aligned sprockets, and a belt drive for the anvil. Likewise, a sprocket 126 (FIG. 4) and aligned sprockets and a belt drive to rotate the slitter assembly. Thus, the slitter and anvil are driven by the drive motor. The drive for the trimmer may take various forms and fall within the claims of this invention.

What is claimed is:

1. A cover signature trimmer apparatus for trimming a long edge of an incoming stream of individually folded, overlapping cover signatures, and for delivering the trimmed cover signatures to a hopper of a pocket feeder of a bindery apparatus, the apparatus comprising:

a first conveyor belt adapted to engage the upper surface of a continuous stream of overlapping cover signatures;

a second conveyor belt adapted to engage the bottom surface of a continuous stream of overlapping cover signatures and to cooperate with the first conveyor belt to convey the continuous stream of cover signatures;

a jogger located on one side of a long edge of said continuous stream of overlapping cover signatures for aligning the cover signature against an opposing surface;

a cutter positioned to trim one edge of said stream of overlapping cover signatures;

means for intermittently driving the first and second belt means to intermittently feed the incoming stream of cover signatures to the cutter; and means for intermittently feeding the trimmed signatures into the hopper of the pocket feeder in a timed relationship to the feeding of signatures from the pocket feeder.

2. A cover signature trimmer apparatus, as set forth in claim 1, wherein said first and second belts each comprise a single belts centered above and below, respectively, of said stream of cover signatures.

3. A cover signature trimmer apparatus, as set forth in claim 1, wherein said first and second belts each comprise a series of belts spaced apart across the width of said stream of cover signatures.

4. A cover signature trimmer apparatus, as set forth in claim 1, which includes a drive for positively driving said first and second conveyor belt means at the same speed.

5. A cover signature trimmer apparatus, as set forth in claim 1, which includes a drive for driving said first and second belt means at the same speed as said incoming stream of cover signatures.

6. A cover signature trimmer apparatus, as set forth in claim 1, wherein said jogger comprises a first side plate fixedly positioned to engage said long edge of said stream of individually folded, overlapping cover signatures, a second side plate positioned adjacent said opposing side of said long edge of said stream of overlapping cover signatures, and means for bodily moving second side plate back and forth in a direction perpendicular to said stream of overlapping cover signatures so that said stream is periodically struck by said second side plate and moved laterally against said first side plate.

7. A cover signature trimmer apparatus, as set forth in claim 6, wherein second side plate is moved back and forth at a rate such that it strikes each folded edge of each cover signature in said stream a number of times.

8. A cover signature trimmer apparatus, as set forth in claim 1, wherein said cutter comprises a cutting wheel positioned to engage the long edge of said stream of individually folded overlapping cover signatures.

9. A cover signature trimmer apparatus, as set forth in claim 8, which includes a disc positioned to engage the long edges of said stream of cover signatures beneath said cutting wheel and cooperating with said cutting wheel to effect trimming of said long edge.

10. A cover signature trimmer apparatus, as set forth in claim 9, wherein said disc has a resilient insert in the edge thereof against which the edge of the cutting wheel bears as it trims the long edge of the stream of cover signatures.

11. A cover signature trimmer apparatus, as set forth in claim 10, wherein said cutting wheel is mounted on a rotary shaft which is rotated by variable speed drive means.

12. A cover signature trimmer apparatus for trimming a long edge of an incoming stream of individually folded, overlapping cover signatures, and for delivering the trimmed cover signatures to a hopper of a pocket feeder of a bindery apparatus, the apparatus comprising:

a first conveyor belt adapted to engage the upper surface of a continuous stream of overlapping cover signatures;

a second conveyor belt adapted to engage the bottom surface of a continuous stream of overlapping cover signatures and to cooperate with the first conveyor belt to convey the stream of overlapping signatures;

a jogger located on the opposing side of said long edge of said continuous stream of overlapping cover signatures to cause alignment against an opposing surface;

a cutter positioned to trim said long edge of said stream of overlapping cover signatures while the same passes over said arcuate surface;

a sensor for sensing the trimmed signatures being deposited into the hopper for determining the rate needed to maintain a predetermined supply of trimmed signatures for the hopper;

an intermittent drive for driving the first and second conveyor belts to supply signatures to the cutter at a rate determined by the sensor in order to maintain a supply of trimmed signatures in the in-line feed hopper of a pocket feeder;

an intermittent drive for the cutter to intermittently trim edges from the long-tail signatures being intermittently fed to the cutter;

an output conveyor for the trimmed signatures feeding the trimmed signatures into the hopper of the pocket feeder; and an intermittent drive for the output conveyor for feeding the trimmed signatures into the hopper of the pocket feeder to maintain trimmed signatures in the hopper as determined by the sensor.

13. A cover signature trimmer apparatus, as set forth in claim 12, wherein said first and second belts each comprise a single endless conveyor belt.

14. A cover signature trimmer apparatus, as set forth in claim 12, wherein said first and second belt each comprise a series of conveyor belts spaced apart across the width of said stream of cover signatures.

15. A cover signature trimmer apparatus, as set forth in claim 12, which includes a drive for positively driving said first, second and third conveyor belt means at the same speed.

16. A cover signature trimmer apparatus, as set forth in claim 12, which includes a drive for driving said first and second conveyor belts at the same speed as said incoming stream of cover signatures.

17. A cover signature trimmer apparatus, as set forth in claim 12, wherein said a jogger comprises a first side plate fixedly positioned to engage said long edge of said stream of individually folded, overlapping cover signatures, a second side plate positioned adjacent said opposing side of said long edge of said stream of overlapping cover signatures, and means for bodily moving second side plate back and forth in a direction perpendicular to said stream of overlapping cover signatures so that said stream is periodically struck by said second side plate and moved laterally against said first side plate.

18. A cover signature trimmer apparatus, as set forth in claim 17, wherein second side plate is moved back and forth at a rate such that it strikes each folded edge of each cover signature in said stream a number of times.

19. A cover signature trimmer apparatus as set forth in claim 12, wherein said cutter comprises a cutting wheel positioned to engage the long edge of said stream of individually folded overlapping cover signatures as they pass over said arcuate surface.

20. A cover signature trimmer apparatus, as set forth in claim 19, which includes a disc positioned to engage the long edges of said stream of cover signatures beneath said cutting wheel and cooperating with said cutting wheel to effect trimming of said long edge.

21. A cover signature trimmer apparatus, as set forth in claim 20, wherein said disc has a resilient insert in the edge thereof against which the edge of the cutting wheel bears as it trims the long edge of the stream of cover signatures.

22. A cover signature trimmer apparatus, as set forth in claim 21, wherein said cutting wheel is mounted on a rotary shaft which is rotated by variable speed drive means.

23. A method of in-line trimming long tail signatures to a hopper of a pocket feeder of a collating bindery apparatus;

providing a log or cylindrical reel of folded long-tail signatures;

feeding signatures from the log and shingling the long-tail signatures in a shingled stream;

jogging the shingled long-tail signatures to cause alignment of edges of the signatures in the stream;

trimming the long edge from the stream of long-tail signatures to form trimmed signatures traveling in a shingled stream;

sensing the length of signatures in the hopper of the pocket feeder; and feeding the trimmed signatures into the hopper of the pocket feeder in a timed relationship to the feed rate of signatures from the pocket feeder to maintain signatures in the hopper and without an overflow of signatures within the hopper.

24. A method in accordance with claim 23 comprising:

sensing the length of signatures in the hopper with a switch; and starting feeding additional trimmed signatures into the hopper and sensing when a predetermined number of signatures are in the hopper.

25. A method in accordance with claim 23 comprising:

intermittently trimming long edges from the signatures by an intermittently operated trimmer and in timed relationship to the intermittent feeding of the signatures.

* * * * *

UNITED STATES PATENT AND TRADEMARK OFFICE

CERTIFICATE OF CORRECTION

PATENT NO. : 6,419,218 B1
DATED : July 16, 2002
INVENTOR(S) : Allen Hartsoe et al.

It is certified that error appears in the above-identified patent and that said Letters Patent is hereby corrected as shown below:

Title page,
Item [73], Assignee, change "Donnelly" to -- Donnelley --

Signed and Sealed this

Eleventh Day of February, 2003

JAMES E. ROGAN
*Director of the United States Patent and Trademark Office*